US005775697A

United States Patent [19]

Snarli

[11] Patent Number: 5,775,697

[45] Date of Patent: Jul. 7, 1998

[54] BETTING AND WAGERING GAME BOARD

[75] Inventor: Roger Sten Snarli, Oslo, Norway

[73] Assignee: Quanto AS, Oslo, Norway

[21] Appl. No.: 836,393

[22] PCT Filed: Oct. 25, 1995

[86] PCT No.: PCT/NO95/00194

§ 371 Date: Jun. 23, 1997

§ 102(e) Date: Jun. 23, 1997

[87] PCT Pub. No.: WO96/14116

PCT Pub. Date: May 17, 1996

[30] Foreign Application Priority Data

Nov. 3, 1994 [NO] Norway ..... 944188

[51] Int. Cl.[6] ..... A63F 3/00

[52] U.S. Cl. ..... 273/274; 273/118 R; 273/287

[58] Field of Search ..... 273/118 R, 123 R, 273/124 R, 268, 269, 287, 138.1, 144 K, 309

[56] References Cited

U.S. PATENT DOCUMENTS

| | | | |
|---|---|---|---|
| 3,104,878 | 9/1963 | Roger | 273/130 |
| 3,851,885 | 12/1974 | Pepkowski et al. | 273/136 |
| 4,277,067 | 7/1981 | Gettleman | 273/287 |
| 4,319,754 | 3/1982 | Yaworsky | 273/287 |
| 4,779,873 | 10/1988 | Joergensen | 273/237 |
| 4,923,200 | 5/1990 | Peterson | 273/309 |
| 5,590,878 | 1/1997 | Takemoto et al. | 273/309 |
| 5,597,163 | 1/1997 | Takemoto et al. | 273/309 |

FOREIGN PATENT DOCUMENTS 2616675 12/1988 France .

*Primary Examiner*—William M. Pierce
*Attorney, Agent, or Firm*—Ladas & Parry

[57] ABSTRACT

A game consists of a playing board (1) divided into a central section (2) and several playing sections (3), one for each player. The playing sections have a series of marker rings (4), preferentially figures and symbols, as well as colours, and devices to enable each player to make his move by means of counters (17, 18) and which move is hidden from the other players. For this purpose each playing section (3) includes a part (5) which can be raised to give access to a service area (6). This contains spaces (15, 16) for holding the counters balls, and for openings (9, 20, 21) to a central space (8) and adjoining service area (6), respectively, which are used when making the desired moves.

10 Claims, 2 Drawing Sheets

BETTING AND WAGERING GAME BOARD

BACKGROUND OF THE INVENTION

The present invention relates to a game comprising a playing board having a plurality of playing sections, one for each player, said playing sections having a series of markings, preferentially figures and symbols, and devices to enable each player to make moves by means of playing devices hidden from the other players, each playing section including a part which can be raised to give access to a service area therebelow, which service area contains at least some of said devices for making desired moves.

Such a game is known from U.S. Pat. No. 3,104,878. This prior art game is a war game and can be played by two players only.

SUMMARY OF THE INVENTION

The purpose of the present invention is to provide a game of the type as above mentioned which is not a war game and which may provide a greater variety of playing modes. Furthermore, the game should be playable by more than two players at a time. To this end, the invention is characterized in that the playing board has a central space with walls bordering on the respective service areas, each of the partitions having a hole connecting the central space with the respective service areas.

Further advantageous features of the invention are given in the dependent claims.

For a better understanding of the invention a more detailed description follows with reference to the exemplifying embodiment shown in the accompanying drawings, where:

DESCRIPTION OF THE PREFERRED EMBODIMENTS

Figure 1:
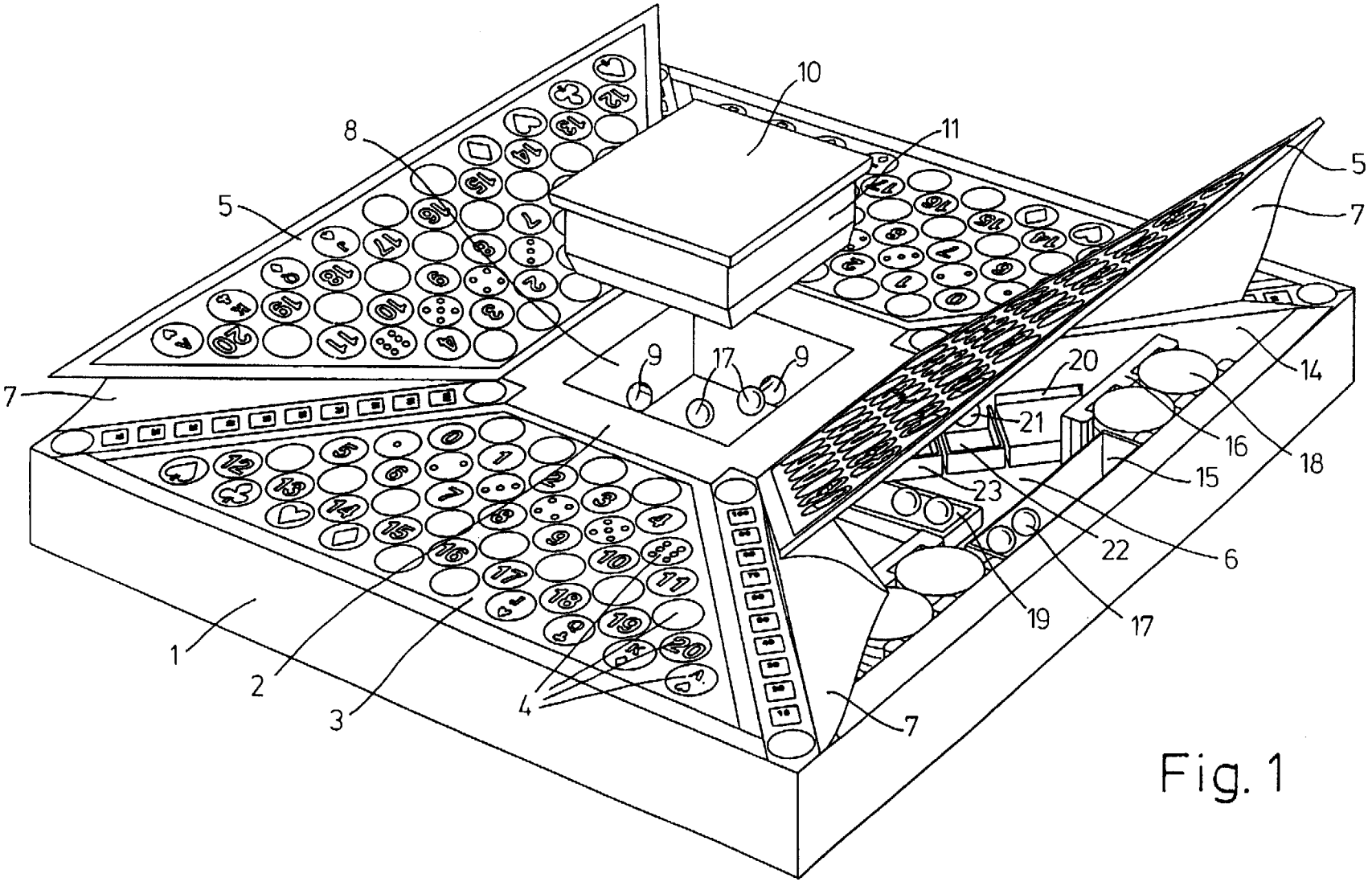
FIG. 1 shows a perspective view of a game according to the invention.

The game as shown in FIG. 1 comprises a playing board 1 having a central section 2 and four playing sections 3, each of which having a series of markings 4 in the form of figures, symbols, colour, etc. Each playing section 3 comprises a part 5 which can be raised to give access to a service area 6 underneath. In the example shown the raisable part 5 is in the form as a trapeze and is hinged to the playing board 1 by the central section 2. The non-parallel sides of the raisable part 5 have flexible walls 7 which prevent sideways viewing into the service area 6 when the part 5 is raised.

The central section 2 has a central space 8 with walls which border onto the respective service areas 6. Each wall has a hole 9 connecting the central space 8 with the respective service area 6.

The central space 8 can be closed by means of a lid 10, which has downwardly extending walls 11 which, when the lid is in place, block the holes 9 into the service area 6.

Figure 2:
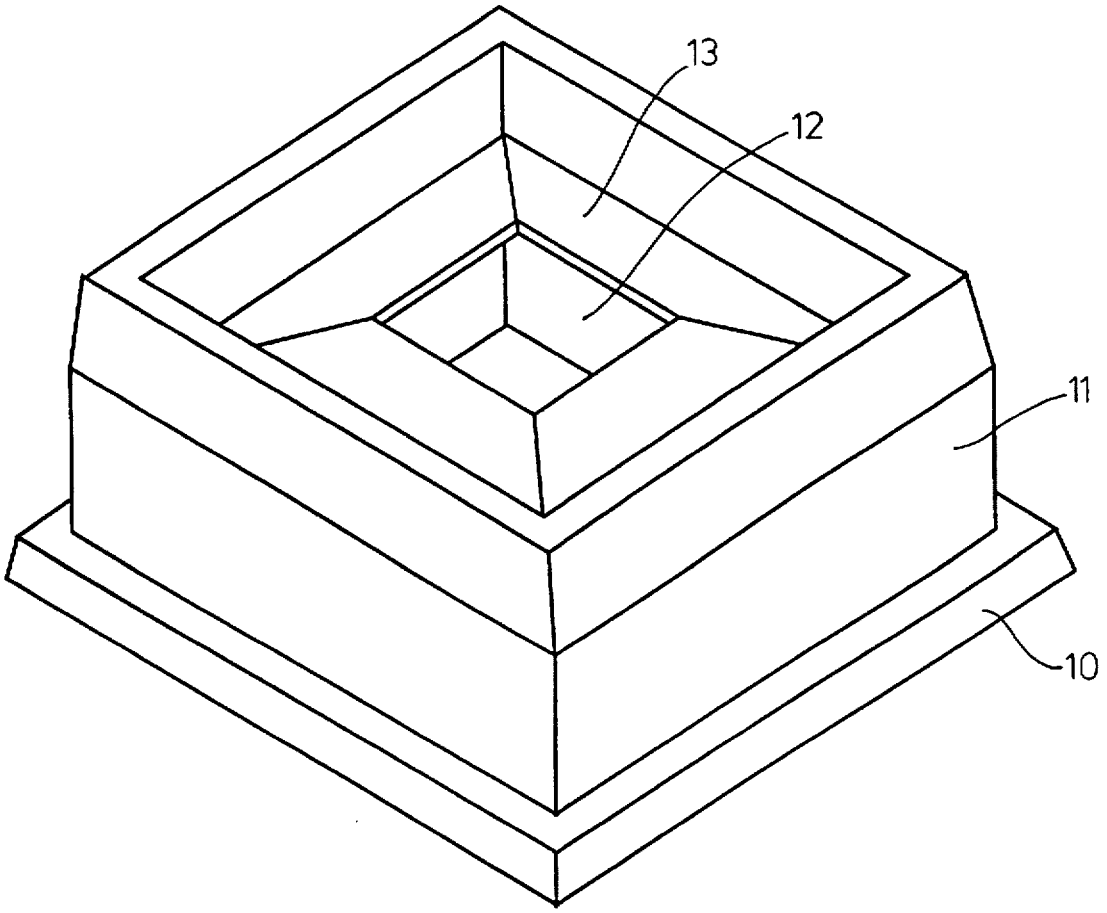
FIG. 2 shows a perspective view of a part comprised by the game in FIG. 1, seen from underneath.

FIG. 2 shows the lid 10 turned upside down. It will be seen that the walls 11 form an internal space 12 into which access is partially limited by the inward-projecting collar 13. the space 12 can be used for shaking one or more dice with the lid positioned as in FIG. 2. The collar 13 helps to keep the dice in place in the space while being shaken and it also makes it more difficult for them to be seen by players when the lid is turned and put in place in the central space 8, where the dice will fall out through the central opening formed by the collar 13.

The service areas 6 are separated from each other by means of partitions 14. The service areas contain storage containers 15, 16 for playing devices, ball/marbles 17 and counters 18. Further, the service area 6 contains a ramp 19 connected to the service area's hole 9 into the central space 8. Marbles 17 which are placed on the ramp 19 will roll into the central space 8 when the hole 9 is opened by lifting the lid 10.

In the partitions 14 between the service areas 6 there are several openings, two of which being visible in FIG. 1. One is a slot 20 through which a counter 18 can be pushed into the adjoining service area. The other opening is a hole 21 through which a marble can be put from the adjoining service area and collected in the collecting box 22. At the side of the hole 21 there is another hole which is not visible. By putting a marble on a ramp 23, the player can send a marble into the neighbouring service area 6, where it will remain in a collecting area similar to the box 22.

According to the invention, the game can be played in a number of ways and with different types of playing devices. When playing by using marbles and counters as shown in FIG. 1, these can, for example, be used in the following way. Given that each of the players has five marbles 17, a number of these (from 0 to 5) can be placed on the ramp 19 while the lid 10 is in place in the central space 8. The purpose of the game then is to guess the total number of marbles which will roll into the central space when the lid is removed. The moves take place when the counters are placed on one of the numbers nil to twenty on the play section 3. If none of the players has guessed correctly when the lid 10 is removed, the stake remains until the next round.

A variation of the game when marbles are used is when each player receives a number of marbles in four different colours. The purpose here is to collect these in order to assemble five marbles of the same colour. A player sends the colours he is not collecting himself on to, e.g., the player on his left by putting the marble into the hole 21 in the partition 14. When a player has assembled five equal-coloured marbles, this can be indicated in various ways, e.g. by putting the marbles on the ramp 19 and letting them roll into the central space 8.

Another way to play is to use dice. One or more dice are shaken in the lid 10, after which the lid is placed in the central space 8 as explained above. The players move by placing counters on one of the dice symbols in their playing sections. The lid 10 is thereupon removed so that the number of dots shown on the dice can be seen and it can be noted which player has chosen correctly.

In a further variation of play, a deck of cards is used having the same symbols as in the playing section. Moves are made by placing counters on one of these symbols. The cards are then turned up one after the other until a card tallies with a symbol that has been gambled on.

In yet another variation only one of the service areas 6 is used, and then by one player who acts as game leader and bank. The game leader selects a number of marbles, possibly also with different colours, which are placed on the ramp 19 in his service area. The other players attempt to guess his combination by placing counters on their own playing sections.

It will be understood that the game according to the invention can be designed in ways other than as shown and described. For example, the number of playing sections can be increased or decreased, and the markings on the playing sections can be varied in kind and number, depending, for example, on the chances given to the players to receive winnings on their stakes. The playing sections 3 may have separate colours and the counters and marbles can have similar colours so that it is easier to see what the individual players have done. Additionally, marbles can be used which have colours other than those of the players in order to increase the variation possibilities of the game. The game is constructed specifically to allow the players to make up their own game methods. A suitable size for a table model with four playing sections could, e.g., be 41×41×3 cm.

I claim:

1. A game comprising: a playing board having a central section surrounded by a plurality of playing sections having markings on a top portion thereof, each of said playing sections being capable of being raised to give access to a service area including playing devices located underneath said playing section, said central section including a plurality of walls defining a central space wherein each of said walls is located adjacent to each of said service areas and each of said walls has a hole which connects said central space with each of said service areas.

2. The game according to claim 1 wherein each of said playing sections has a trapezoid shape and is hinged to said central section and wherein each of said playing sections further has non-parallel sides with downwardly depending flexible walls which prevent sideways viewing into the service area when said playing section is raised.

3. The game according to claim 2 wherein said central space has a removable lid.

4. The game according to claim 3 wherein said lid has downwardly depending walls so that when said lid is placed on top of said central space, said downwardly depending walls block said holes in said walls which connects said central space with each of said service areas.

5. The game according to claim 4 wherein said downwardly depending walls are adjacent to an inwardly projecting collar piece which limits the opening between said walls of said lid.

6. The game according to claim 1 wherein said service areas are connected to each other by partitions.

7. The game according to claim 6 wherein said partition have holes for the transfer of said playing devices.

8. The game according to claim 7 wherein a collection box for said playing devices is located on either side of said partition.

9. The game according to claim 1 wherein said service area has a ramp which connects said service area hole to said central space.

10. The game according to claim 1 wherein said service areas have storage devices for said playing devices.

* * * * *